US007059251B1

(12) United States Patent
Khanna et al.

(10) Patent No.: US 7,059,251 B1
(45) Date of Patent: Jun. 13, 2006

(54) PROPELLING CHARGE SUPPORT FOR A MORTAR CARTRIDGE

(75) Inventors: Vishwa Khanna, Randolph, NJ (US); Richard C. Dzury, Dover, NJ (US); David Ondre, Piscataway, NJ (US); Jason B. Runell, Andover, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 42 days.

(21) Appl. No.: 10/711,304

(22) Filed: Sep. 9, 2004

(51) Int. Cl.
*F42B 5/38* (2006.01)
*F42B 8/20* (2006.01)

(52) U.S. Cl. ..... 102/282; 102/445; 102/498; 102/529; 206/3

(58) Field of Classification Search ..... 102/282, 102/444, 445, 498, 529, 391, 373, 283, 285, 102/288, 291, 293; 206/3
See application file for complete search history.

(56) References Cited

U.S. PATENT DOCUMENTS 2,052,546 A * 9/1936 Brandt ..... 102/373
2,718,191 A * 9/1955 Garrahan ..... 102/373
3,112,671 A * 12/1963 Dunham et al. ..... 434/12
3,124,070 A * 3/1964 Jasse ..... 102/373
3,339,487 A * 9/1967 Umbach et al. ..... 102/444
4,109,579 A * 8/1978 Carter ..... 102/513
4,549,487 A * 10/1985 Jensen ..... 102/498
4,711,180 A * 12/1987 Smolnik ..... 102/445
4,898,097 A * 2/1990 Jordan et al. ..... 102/283
5,228,855 A * 7/1993 Frost ..... 434/12
5,503,080 A * 4/1996 Goward et al. ..... 102/293
5,677,509 A * 10/1997 Potvin et al. ..... 102/498
6,059,573 A * 5/2000 Patel ..... 434/16
6,779,463 B1 * 8/2004 Mutascio et al. ..... 102/502
6,837,164 B1 * 1/2005 Khanna et al. ..... 102/373
6,955,125 B1 * 10/2005 Mazzei et al. ..... 102/445

* cited by examiner

*Primary Examiner*—Michael J. Carone
*Assistant Examiner*—Bret Hayes
(74) *Attorney, Agent, or Firm*—John F. Moran

(57) ABSTRACT

A propelling charge support comprises horseshoe-shaped clips for engaging the tail fin and holding the propelling charges together for protection, a rounded saddle for holding the propelling charges of the cartridge, and winged edges to protect the propelling charges and aid in removal of the propelling charge support from the tail fin. The propelling charge support further comprises a flat outer surface on which the propelling charge support loaded with propelling charges can rest while being installed onto the tail fin. It comprises a fin engagement clip that interfaces with a fin blade when installed on the cartridge, and that prevents rotation of the propelling charge support and propelling charges about the tail fin axis during rough handling and transportation, preventing damage to the propelling charges.

10 Claims, 6 Drawing Sheets

PROPELLING CHARGE SUPPORT FOR A MORTAR CARTRIDGE

FEDERAL INTEREST STATEMENT

The inventions described herein may be manufactured, used and licensed by or for the U.S. Government for U.S. Government purposes.

FIELD OF THE INVENTION

The present invention generally relates to protection of munitions during storage, transportation and handling. More specifically, the present invention pertains to a propelling charge support for protecting 60 mm mortar cartridge propelling charges without the use of foam. In addition, the invention also serves as an assembly aid.

BACKGROUND OF THE INVENTION

Munitions, such as 60 mm mortar cartridges, typically utilize some form of propelling charge support assembly to protect the propelling charges during transportation and handling. Conventional propelling charge support assemblies utilize foam to cushion the 60 mm mortar cartridge propelling charges. Although conventional propelling charge support assemblies have proven to be useful, it would be desirable to present additional improvements.

The type of foam utilized on the conventional propelling charge support assembly is required to meet stringent performance requirements during tactical use. Foam that meets these stringent performance requirements has been difficult to procure and can be expensive. Further, foam degrades with age. As the foam degrades, the ability of the propelling charge support assembly to protect munitions also degrades. In addition, conventional propelling charge support assemblies using foam require additional manpower during assembly, which leads to higher propelling charge support assembly unit costs.

What is needed is a propelling charge support for munitions that does not require foam yet still provides adequate protection for the 60 mm mortar cartridge during transportation and handling. The need for such a system has heretofore remained unsatisfied.

SUMMARY OF THE INVENTION

The improved propelling charge support satisfies this need, providing protection without the use of foam for munitions such as a 60 mm mortar cartridge. The improved propelling charge support comprises horseshoe-shaped clips for engaging the tail fin and holding the cartridge together for protection. The tail fin comprises six individual fin blades. The improved propelling charge support further comprises a rounded saddle for holding the propelling charges securely. The improved propelling charge support has winged edges to protect the charges and aid in removal of the propelling charge support from the tail fin of the cartridge. The improved propelling charge support further comprises a flat outer surface on which the propelling charge support can rest while the propelling charge support is assembled to the cartridge tail fin.

In one embodiment, the improved propelling charge support comprises a fin engagement clip that interfaces with an individual fin blade on the tail fin when installed on the cartridge. The fin engagement clip prevents rotation of the improved propelling charge support and propelling charges about the tail fin axis, preventing damage to the propelling charges.

The improved propelling charge support eliminates the use of foam, while still providing protection to the cartridge during transportation and handling. This is a less expensive alternative to conventional propelling charge support assemblies because the foam is expensive and difficult to obtain. The improved propelling charge support has long life and resists degradation through age.

Further, eliminating the use of foam reduces manufacturing time compared to that of conventional approaches. Conventional propelling charge support assemblies require foam be secured to the propelling charge support with glue or tape. This process is time consuming and expensive.

BRIEF DESCRIPTION OF THE DRAWINGS

The various features of the present invention and the manner of attaining them will be described in greater detail with reference to the following description, claims, and drawings, wherein reference numerals are reused, where appropriate, to indicate a correspondence between the referenced items, and wherein:

DETAILED DESCRIPTION OF PREFERRED EMBODIMENTS

Figure 1:
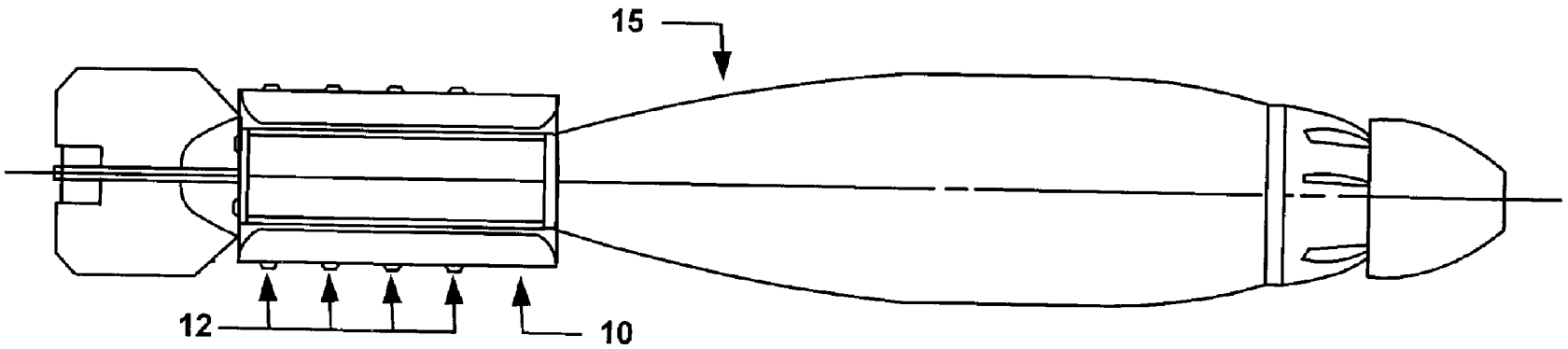
FIG. 1 is a cross-sectional view of an exemplary operating environment in which an improved propelling charge support of the present invention can be used.

FIG. 1 illustrates an exemplary environment in which a system and method for protecting a 60 mm mortar cartridge prior to use with an improved propelling charge support (the foamless propelling charge support 10) may be used. In one embodiment, the improved propelling charge support 10 comprises injection molded high impact polystyrene, High Density Polyethylene (HDPE) or other resins meeting equivalent performance. Sequential rough handling tests shall be performed to qualify appropriate resin materials for meeting performance requirements.

As shown in the cut away drawing of FIG. 1, improved propelling charge support 10 protects the four propelling charges shipped with a 60 mm mortar cartridge 15 (also referenced herein as cartridge 15).

Figure 2B:
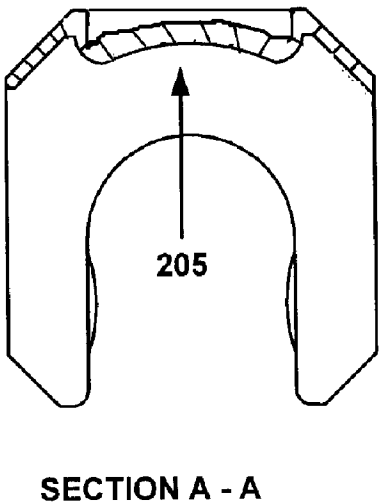
FIG. 2 is comprised of FIGS. 2A and 2B that illustrate a perspective view and a cross-sectional view of the side of the improved propelling charge support of FIG. 1, respectively.
Figure 2A:
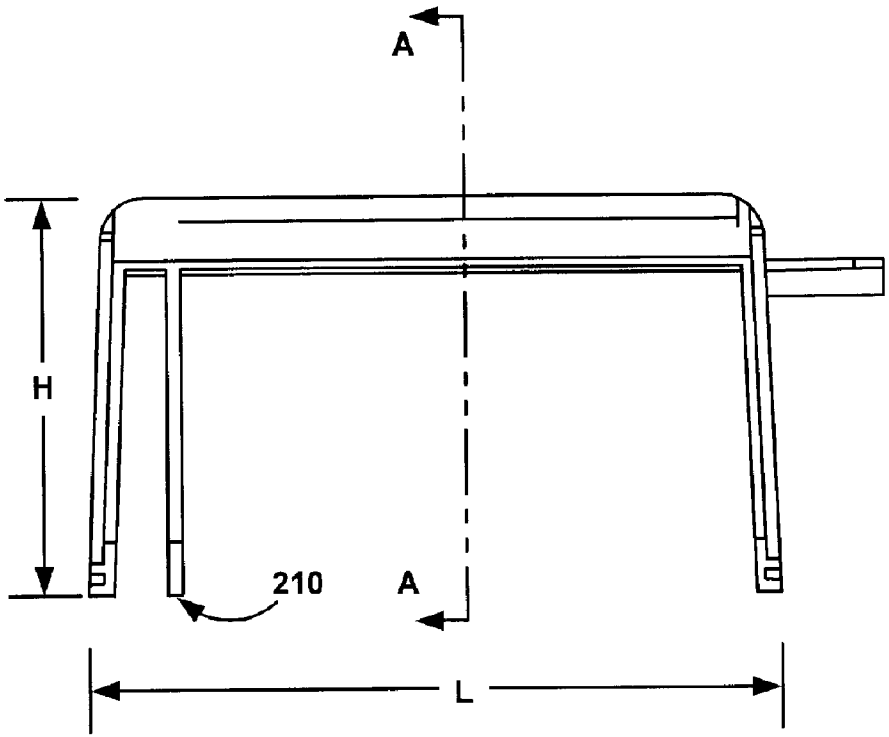

The improved propelling charge support 10 is illustrated by the long side perspective view of FIG. 2. The length L of the improved propelling charge support 10 is approximately 9.86 cm, the height H is approximately 4.83 cm, and the width W(see FIG. 3) is approximately 4.45 cm.

The improved propelling charge support 10 comprises a rounded saddle 205 with aggressive etching. The rounded saddle 205 comes in contact with the propelling charges 12. The aggressive etching of the rounded saddle 205 prevents movement of the propelling charges 12 relative to the improved propelling charge support 10.

The improved propelling charge support 10 comprises retaining clips 210 for engaging the tail fin of the cartridge 15. The improved propelling charge support 10 further comprises two detented clips 215 for engaging the propelling charges 12. One non-detented clip 210 is illustrated in FIG. 2. The retaining clips 215 and the non-detented clip 210 are shaped to constrain propelling charges 12 during transportation and handling. The non-detented clip 210 and the retaining clip 215 keep charges from moving along a cartridge during transportation or severe handling such as a drop.

Figure 3:
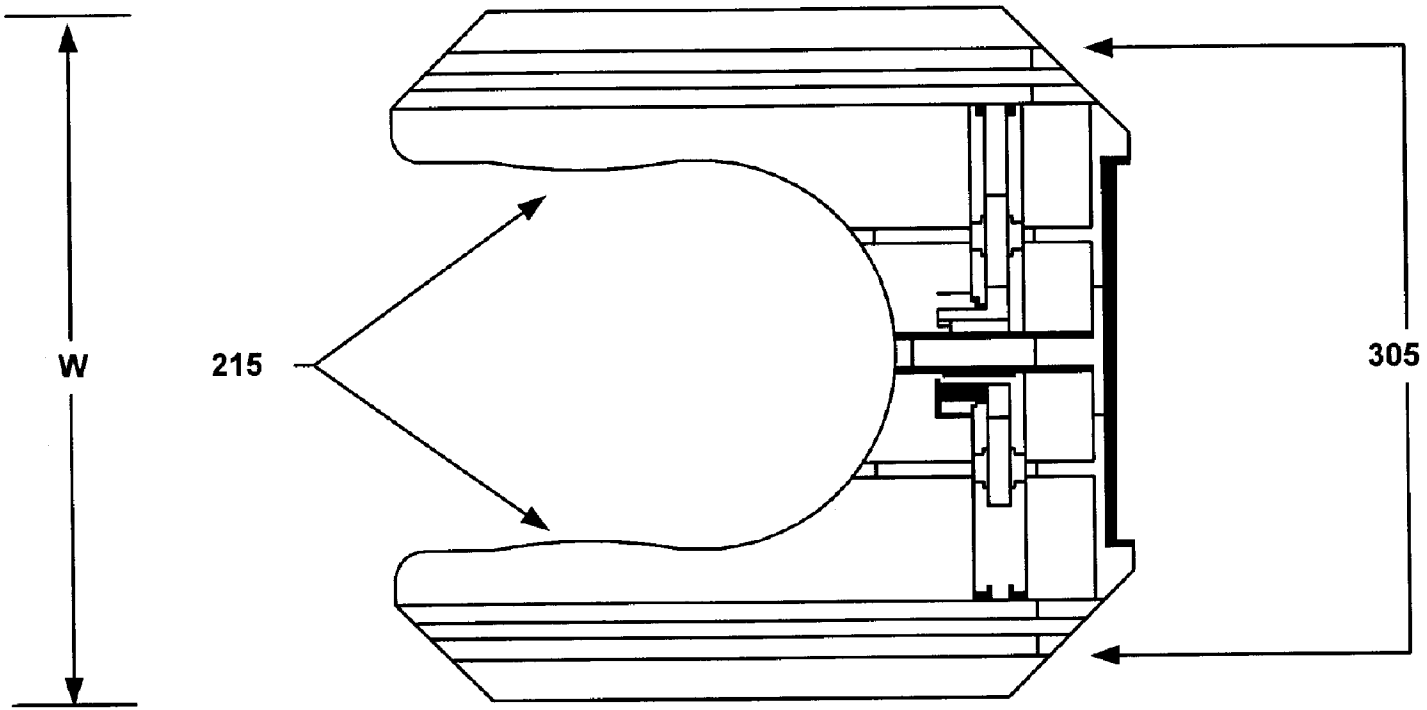
FIG. 3 is a diagram illustrating a perspective view of a tail end of the improved propelling charge support of FIG. 1.

The improved propelling charge support 10 is further illustrated by the end perspective view of FIG. 3. The improved propelling charge support 10 comprises winged edges 305. The winged edges 305 protect the propelling charges 12 from impact and aid during removal of the improved propelling charge support 10 from the cartridge 15.

Figure 4:
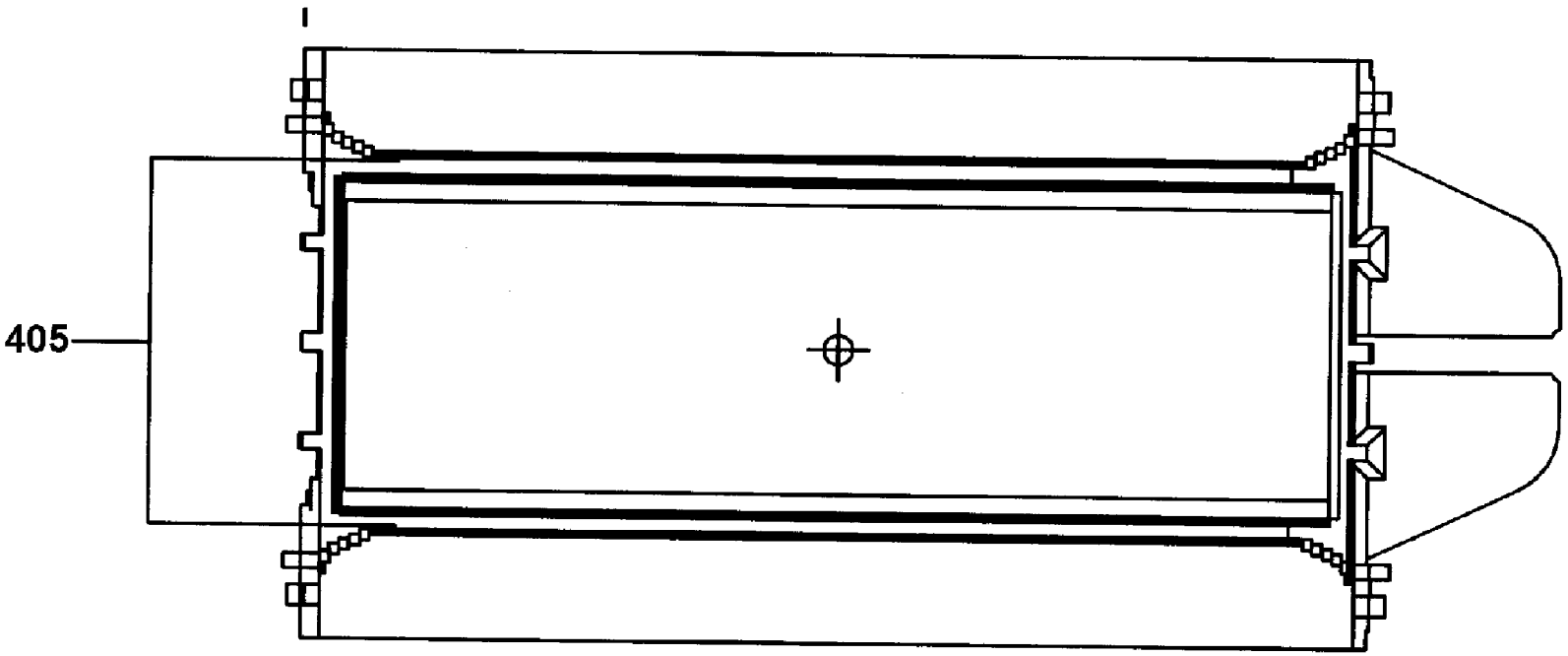
FIG. 4 is a diagram illustrating a perspective view of the top of the improved propelling charge support of FIG. 1.
Figure 6:
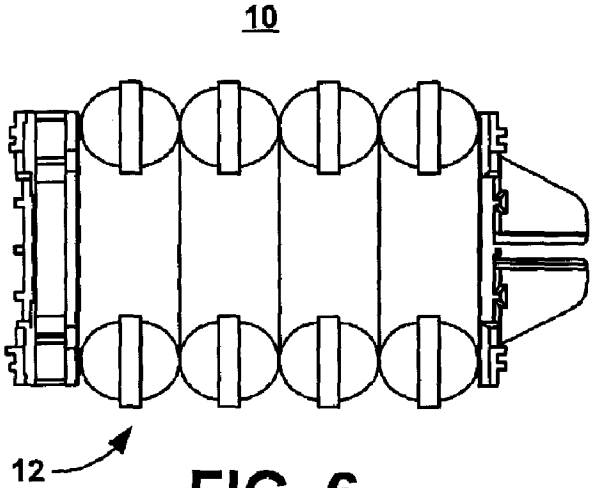
FIGS. 6 and 7 are diagrams illustrating the orientation of the propelling charges within the propelling charge support prior to assembly to the cartridge.
Figure 7:
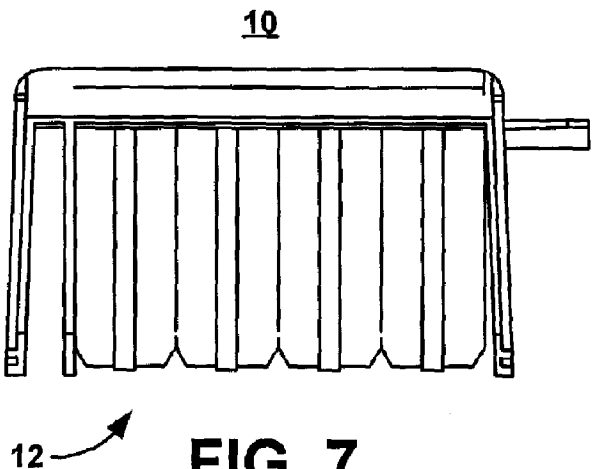

FIG. 4 is a diagram illustrating a bottom perspective view of the improved propelling charge support 10. A flat outer surface 405 opposite the rounded saddle 205 allows the improved propelling charge support 10 to sit on a flat surface. The flat outer surface 405 aids during load, assemble, and pack (LAP) operations by allowing propelling charges 12 to be set up within the foamless propelling charge support 10 prior to installation to tail fin of cartridge 15. The improved propelling charge support 10 and propelling charges 12 are then installed (as a unit) on the cartridge 15 while the propelling charges 12 are sitting in the improved propelling charge support 10. FIG. 6 depicts the improved propelling charge support with propelling charges installed and their orientation for use as an assembly aid.

Figure 5:
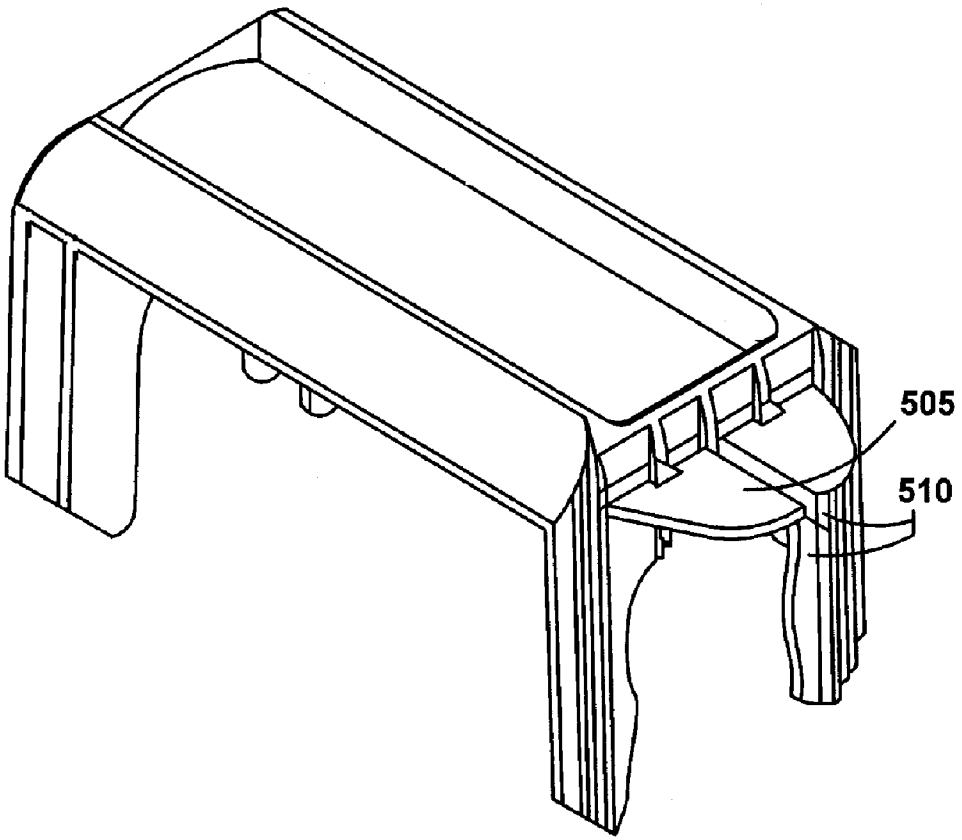
FIG. 5 is a diagram illustrating a further perspective view of the tail end of the improved propelling charge support of FIG. 1 featuring a fin stabilizer.

FIG. 5 is a diagram illustrating an end perspective view of one embodiment of the improved propelling charge support 10. In this embodiment, the improved propelling charge support 10 comprises a fin engagement clip 505. The fin engagement clip 505 comprises protrusions 510 that interface with a single fin blade on the cartridge 15. The fin stabilizer 505 prevents rotation of the improved propelling charge support 10 and the propelling charges 12 about the center axis, preventing damage to the propelling charges 12.

It is to be understood that the specific embodiments of the invention that have been described are merely illustrative of certain applications of the principle of the present invention. Numerous modifications may be made to the system and method for protecting a 60 mm mortar cartridge prior to use with an improved propelling charge support described herein without departing from the spirit and scope of the present invention.

What is claimed is:

1. A propelling charge support for protecting a mortar cartridge having a tail fin and including a plurality of propelling charges prior to use, of the mortar cartridge comprising:

at least one retaining clip for constraining the propelling charge support to the tail fin assembly of the mortar cartridge;

a non-detented clip for constraining the propelling charges;

a rounded saddle with an etched surface for supporting a propelling charge to a tail of the mortar cartridge, wherein the tail forms part of the tail fin assembly;

a winged edge for protecting the propelling charge from impact and for aiding in removal of the propelling charge support from the mortar cartridge; and a generally flat outer surface for allowing the propelling charge support to rest on a flat surface during installation.

2. The propelling charge support of claim 1, wherein the retaining clip and the non-detented clip are disposed on opposite ends of the propelling charge support.

3. The propelling charge support of claim 1, wherein an exterior surface of the propelling charge support opposite the rounded saddle comprises the winged edge.

4. The propelling charge support of claim 3, wherein the exterior surface of the propelling charge support opposite the rounded saddle comprises the flat outer surface.

5. The propelling charge support of claim 1, wherein the mortar cartridge is a 60 mm mortar cartridge; and wherein the retaining clip is approximately 9.86 cm long.

6. The propelling charge support of claim 1, wherein the mortar cartridge is a 60 mm mortar cartridge;

where in the saddle is approximately 4.45 cm wide.

7. The propelling charge support of claim 1, wherein the mortar cartridge is a 60 mm mortar cartridge;

wherein the non-detented retaining clip is approximately 4.83 cm high.

8. The propelling charge support of claim 1, wherein the propelling charge support is made of injection molded material comprising high-impact polystyrene, or high density polyethylene (HDPE).

9. The propelling charge support of claim 1, further comprising a fin engagement clip for interfacing with a fin blade on the tail fin to prevent rotation of the propelling charges about the tail fin axis.

10. The propelling charge support of claim 9, wherein the fin engagement clip comprises protrusions that interface with a fin on the tail fin.

* * * * *